United States Patent [19]

Philberth et al.

[11] 4,361,823

[45] Nov. 30, 1982

[54] CORE LAMINATIONS FOR SHELL-TYPE CORES, ESPECIALLY FOR TRANSFORMERS

[75] Inventors: Karl Philberth; Bernhard Philberth, both of Puchheim, Fed. Rep. of Germany

[73] Assignee: Wilfried Ernst Sawatzky, North Balwyn, Australia

[21] Appl. No.: 173,243

[22] Filed: Nov. 26, 1979

[30] Foreign Application Priority Data

May 19, 1979 [DE] Fed. Rep. of Germany ..... 2920365

[51] Int. Cl.[3] ..... H01F 27/24

[52] U.S. Cl. ..... 336/212; 336/217

[58] Field of Search ..... 336/165, 217, 212, 216, 336/234, 178

[56] References Cited

U.S. PATENT DOCUMENTS

| | | | |
|---|---|---|---|
| 2,143,745 | 1/1939 | Sola | 336/165 X |
| 2,489,977 | 11/1949 | Porter | 336/218 X |
| 2,806,199 | 9/1957 | Sola | 336/165 X |
| 3,461,758 | 8/1969 | Michiulis | 336/212 X |
| 3,546,571 | 12/1970 | Fletcher et al. | 336/165 X |
| 4,149,136 | 4/1979 | Philberth et al. | 336/217 |
| 4,158,186 | 6/1979 | Philberth et al. | 336/217 |

FOREIGN PATENT DOCUMENTS

| | | | |
|---|---|---|---|
| 2139010 | 3/1973 | Fed. Rep. of Germany | 336/216 |
| 1558102 | 1/1969 | France | 336/216 |

OTHER PUBLICATIONS

"Technische Angaben Zum Pmz", Philberth, Feb. 1978.

*Primary Examiner*—Thomas J. Kozma

[57] ABSTRACT

The invention concerns EI-type core laminations, especially for transformers. The E-piece has a center leg of width f, two outer legs of width b, a yoke of width $c_1$ and two windows of width h and length e. The I-piece has the width $c_2$. The laminations have the following ratios:

e is greater than 3 f/2 and less than 3.5 f/2;

$c_1$ and b are both at least 1.1 f/2;

$c_1-c_2$ is at least 0.1 f/2;

$c_1+c_2$ is at least 2.1 f/2 and at most 2.5 f/2.

A preferred embodiment of the invention has the ratios: $e=3.25$ f/2; $c_1=b=1.25$ f/2; $c_2=h=f/2$.

21 Claims, 2 Drawing Figures

CORE LAMINATIONS FOR SHELL-TYPE CORES, ESPECIALLY FOR TRANSFORMERS

The present invention relates to core laminations for shell-type cores, especially for transformers comprising a plurality of core laminations arranged in layers, each of said core laminations having a center leg, two outer legs parallel thereto at a certain distance, and two yokes connecting the ends of said legs, one yoke, which will be called the jointlessly connected yoke, being connected without joints to said legs, the other yoke, which will be called the parted yoke, having joints provided between itself and the center leg and between itself and the outer legs.

It is proposed by the present invention to improve the conventional core laminations of this type, the so called EI core laminations, by means of the features described hereinafter.

The waste free EI core laminations of the DIN series (series of the German Industrial Standard) have the following ratios: The length of each window is 3 times half the width of the center leg, the width of the jointlessly connected yoke and the width of each of the two outer legs are equal to half the width of the center leg, the difference between the width of the jointlessly connected yoke and the width of the parted yoke is zero, the sum of the width of the jointlessly connected yoke and the width of the parted yoke is equal to the width of the center leg.

These conventional EI core laminations have decisive shortcomings. Their yokes and outer legs have unfavourable dimensions, their joints and fastening holes bottle neck the magnetic flux. Hence, EI cores consisting of such laminations have considerable magnetizing current and high magnetic leakage. The invention solves the problem of reshaping the known EI core laminations in such a way that their shortcomings are reduced or avoided, their favourable characteristics are preserved and in particular their ratio of efficiency to cost is increased. According to the invention the solution to the problem is provided by core laminations of the kind described above, wherein the length e of each window is greater than 3 times and less than 3.5 times half the width f/2 of the center leg, wherein the width $c_1$ of the jointlessly connected yoke and the width b of each of the two outer legs are each at least 1.1 times half the width f/2 of the center leg, wherein the difference between the width $c_1$ of the jointlessly connected yoke and the width $c_2$ of the parted yoke is at least 0.1 times half the width f/2 of the center leg and wherein the sum of the width $c_1$ of the jointlessly connected yoke and the width $c_2$ of the parted yoke is at least 2.1 times and at most 2.5 times half the width f/2 of the center leg.

Entirely waste free core laminations of this type can be obtained by means of the following additional measures. The length e of each window of the E-part, which is the same as the length of the E center leg and of each E outer leg, is about equal to the sum of half the width f/2 of the center leg, the width h of each window and the width b of each outer leg. The width $c_2$ of the parted yoke, i.e. of the I-part, is about equal to the width h of each window. Moreover, the width $c_1$ of the jointlessly connected yoke may be equal or nearly equal to the width b of each outer leg.

By means of these invention based measures, and in particular by utilising said additional measures, cores can be realised which are provided with two windows each having a length $e_K$ of 3 times and a width h of one times half the width f/2 of the center leg (these ratios being in accordance to the DIN-E-Series) and wherein at the same time the following four shortcomings can be practically eliminated or at least substantially reduced.

Firstly: the crystal structure along the cut edges of the stamped out lamination is impaired or disturbed. This deteriorates the magnetic properties over a width approximately equal to the thickness of the lamination. These edge disturbances can only be eliminated partly by means of costly recrystallisation by annealing at high temperatures. Whereas the magnetic flux path in the center leg is bordered by only two boundaries of disturbed magnetic zones, the flux path in both the yokes and both the outer legs is bordered by four such zones. In case of conventional waste free core laminations, having yokes and outer legs of half the width of the center leg, the detrimental effect is therefore about doubled for three quarters of the length of the magnetic path.

On the other hand, in the case of core laminations of the invention having widened yokes and outer legs relative to half the width of the center leg, the detrimental effect due to the magnetic disturbance zones in the yokes and the outer legs disappears practically completely so that only one fold of the detrimental effect remains for only about one quarter of the magnetic path length due to the unavoidable two disturbance zones which border the center leg.

Secondly: a constriction occurs in the magnetic path cross-section at the fastening holes. These constrictions can not really be avoided because the fastening holes are very useful for mounting purposes. In conventional waste free core laminations having yokes and outer legs of half the width of the center leg, the fastening holes in the yokes lead to constrictions of about 30% for small types and up to about 10% for large types, corresponding to a shear-point with 0.7 to 0.9 fold center leg saturation. Since the constrictions above the shear-point become effective at a few percent of the total path length and the required excitation increases exponentially with the flux density, the maximum utilisable flux is reduced by this bottle neck. Hence it is not possible to use the full flux determined by the center leg material as such. Furthermore, the magnetic fields which are forced from the iron into the space of, and surrounding the fastening holes, result in additional heat losses associated with the mounting screws or pins.

On the other hand, there remain, in the case of core laminations of the invention having widened yokes and outer legs relative to half the width f/2 of the center leg—for the dimensions especially mentioned below—at the fastening holes relative to the center leg, cross-sectional enlargements of 3% for small types and up to 20% for large types. The useful flux is therefore not significantly reduced by the fastening holes and there are few, if any, side effects, not even with Goss grain-oriented material which is usually very unfavourably affected by such constrictions.

Thirdly: increased magnetic reluctance occurs at the gaps of two-piece laminated cores. In conventional waste free EI-core laminations having yokes and outer legs of half the width of the center leg, the uninterrupted continuous iron cross-section is reduced to 50% for alternate layers with a shear-point with 0.5 times center leg saturation. At a flux density in the center leg above the shear-point, magnetic flux has to be forced increasingly across the gaps of the abutting core lamination sections. For gaps which are as small as possible from a technical point of view, the resulting increase in reluctance—and hence the magnetising current and magnetic leakage—is considerable and furthermore lead to troublesome harmonics. As far as the magnetising current is concerned the increase in magnetic resistance or reluctance at the ends of the center leg and the outer legs act as series connected. Regarding the magnetic leakage almost only the increases in magnetic resistance at the ends of the outer legs have an effect. Because the width of the abutting gaps vary unavoidably during large scale production of the cores, the resulting variations in characteristics are even greater, so that the guaranteed values generally have to be lower as a result. This aspect of the abutting gaps is the main reason why, apart from waste free and therefore cheaper EI-sections, there are still comparably many M-sections used, in spite of their considerable waste of material.

In contrast, in core laminations of the invention having a greater length e for each window relative to 3 times half the width f/2 of the center leg and a width $c_1$ of the jointlessly connected yoke greater than the width $c_2$ of the parted yoke, the gap reluctance is reduced to a fraction thereof for a core where laminations are alternately interleaved and arranged in layers. This is achieved because the abutting joints between the ends of the legs and the parted yoke, running parallel to the yoke, are displaced in the longitudinal direction of the core away from the inside edge of the jointlessly connected yoke to the interior of the yoke core by a distance z, so that the ends of the E-legs are overlapped or covered up for the distance z by the jointlessly connected E-yoke parts of the inverted E-sections and consequently uninterrupted continuous material cross-sections are formed by means of the covering portions of the jointlessly connected yoke. In alternately interleaved lamination layers having the outer edges of the yoke in one plane this distance z is equal to the difference $c_1-c_2$ of the width $c_2$ of a parted yoke. The shear-point is thereby increased. Because of the widened outer legs the shear-point is still further increased at the abutting joints of the outer legs.

Considerable improvements are already obtained at a length e of each window of 3.1 times half the width f/2 of the center leg and at a difference of yoke widths $c_1-c_2$ of 0.1 times half the width f/2 of the center leg. At a length e of 3.4 times and a difference of yoke widths $c_1-c_2$ of 0.4 times half the width f/2 of the center leg the additional reluctances at the joints and in the yokes fall well below the reluctance of the center leg; useful in high quality cores at somewhat higher iron expenditure. Very favourable ratios of efficiency to cost are obtained with a length e of each window of 3.2 to 3.3 times half the width f/2 of the center leg and with a difference of yoke widths $c_1-c_2$ of 0.2 to 0.3 times half the width of the center leg. A length e of each window of about 3.25 times and a difference in yoke widths $c_1-c_2$ of about 0.25 times half the width f/2 of the center leg results in a negligible variation from the ideal ratios, for all materials. This corresponds—expecially at a width $c_2$ of the parted yoke equal to a width h of each window—to a width $c_1$ of the jointlessly connected yoke and a same width b of each outer leg to 1.25 times half the width f/2 of the center leg. For example, these dimensions increase the uninterrupted continuous iron cross-section (relative to the center leg cross-section) to 62.5% at the ends of the center leg and to 75% at the ends of the outer legs; the shear-point corresponding to 0.625 or 0.75 times the center leg saturation. The shear-points therefore come close or closer to the practical operating flux density so that only very much less flux has to be forced across the gaps; additionally the gap cross-sections have been increased by 25 or respectively 50%. In relation to the magnetising current practically only the reluctance at the ends of the center leg is therefore of importance and operative and this reluctance is already reduced to only a fraction. In regard to the magnetic leakage practically only the reluctance at the ends of the outer legs have any effect and this said reluctance has almost completely disappeared. In addition, harmonics in the magnetising current and the magnetic leakage as well as the variations which normally occur in large scale production are considerably reduced.

Fourth: the core laminations of the invention have yokes and outer legs which are widened, relative to half the width f/2 of the center leg, so much as to provide the most economical use of the material. Furthermore this widening improves the quality with regard to the border zones, the holes and the joints—as described above. Hence, no additional expenditure is required to achieve these improvements. Because of these kinds of increases in width, i.e. enlargements of cross-section, the excitations and iron losses are drastically reduced in the yokes and the outer legs relative to the center leg and the iron cooling surface is enlarged so that the total permissible losses allow the flux density in the coil enclosed center leg to be increased, i.e. higher output is obtained with the same copper winding. However, as the magnetisation function in the region of practical use represents a steep exponential function, maximum efficiency per cost or expenditure result from specific increases in width.

In a special embodiment of the invention the yokes are widened to a different degree than the outer legs, relative to half the width f/2 of the center leg, i.e. the yokes are widened to a lesser extent than the outer legs. If the variation is not too large then the magnetising currents will not be significantly increased relative to a uniform increase in widths. The magnetic leakage on the other hand is considerably reduced as the magnetomotive force which results in the magnetic leakage is integrated out from the zero point (in the center of the outer legs) along the reluctances up to the end of the center leg. In M-cores it is nevertheless preferred to make the yokes wider than the outer legs as there are no joints at the ends of the outer legs, and for Goss grain-oriented material, the flux flows perpendicularly to the preferential direction through the entire M-yoke cross-section. On the other hand, in EI-cores the E-yoke sections are perpendicular and the I-yokes are parallel to the preferential direction and it is advantageous to make the outer legs wider than the yokes.

In any case there are considerable improvements when the sum $c_1+c_2$ of the width $c_1$ of the jointlessly connected yoke and the width $c_2$ of the parted yoke is 2.1 times half the width f/2 of the center leg. A sum $c_1+c_2$ of 2.2 to 2.3 times half the width f/2 of the center leg results in a very favourable ratio of efficiency to cost. A sum of yoke widths $c_1+c_2$ of 2.25 times half the width f/2 of the center leg provides for practically any useful material a result which does not vary by a significant degree from the achievable optimum which could be obtained. The same applies for the important Goss grain-oriented material. In practical operation and together, to some extent, with a yoke width difference $c_1 - c_2$ of 0.25 times half the width f/2 of the center leg, there is about the same amount of flux in the core yoke intermediate sections (above the windows) in the parallel I-section as in the perpendicular cross-sectionally enlarged E-yoke sections and the magnetising current required for these intermediate yoke sections is about the same as that required for the center leg. On the other hand, the magnetising current required for the more enlarged cross-sections of the yoke sections above the legs, and in particular in the outer legs, is considerably reduced.

In every case there are considerable improvements if the width b of each outer leg is 1.1 times half the width f/2 of the center leg. A width b of each outer leg of 1.2 to 1.3 times half the width f/2 of the center leg provides particularly favourable ratios. A width b of each outer leg of 1.25 times half the width f/2 of the center leg does not depart very much from the optimum for practically any material. By means of yokes and outer legs using these dimensions, overcompensation—even in the case of Goss grain-oriented material—for the increase in magnetising current due to the combined use of the E-yoke sections which are perpendicularly traversed by flux can be achieved, namely by the reduction in magnetising current due to the cross-section enlargements according to the invention. This overcompensation is achieved in such a way that an EI-core according to the invention requires even less magnetising current for the same flux density in the center leg than a C-core or band core, or given the same magnetising current as a C-core the flux density of the center leg is higher than that of the C-core. This is contrary to a generally held prejudice. The advantages with respect to conventional waste free EI-cores are of course greater than those relative to a C-core, namely for isotropic material but even more for Goss grain-oriented material. Also because conventional alternately stacked Goss grain-oriented material EI-core laminations have perpendicular E-yoke sections of only half the cross-section width of the center leg, along the entire yoke length and also because the parallel I-sections are of the same width, a magnetising current of more than 10 times the magnetising current for the center leg has to be generated for the yoke in the practical working range of flux.

Such perfect utilisation of materials in the shell-type core of the invention is only fully achieved because the adverse effects due to magnetic disturbance zones, fastening holes and gaps are simultaneously eliminated. In small types in which the iron losses are still relatively small, the significant performance improvements are effected above all by the reduced influence of the border zones, the fastening holes and the abutting joints. These are improved especially by the invention since the increase in flux density results in an increase in induced voltage, without any additional potential drop across the windings and an improvement of copper utilisation becomes possible by having fewer windings of thicker wire. In larger types in which the effects of the disturbance zones, fastening holes and abutting joints are relatively smaller, the relative reduction in iron losses and the enlarged iron cooling surfaces are more effective.

The invention therefore provides for the first time waste free EI-core laminations for all sizes having ideal electromagnetic characteristics and complete material utilisation. A core produced according to the invention provides an even higher flux in the coil enclosed center leg, which determines the utilisation of copper, than a C-core. The core can be used almost up to saturation. In contrast to the waste free conventional EI-cores, an EI-core of the invention having the same core window dimensions as a comparable conventional EI-core and having the same stacking height and having about 22% more iron of the same quality, will have about 5% greater total cost but a 15% greater output, with simultaneously reduced magnetic leakage. Simultaneously, harmonics in the magnetising current and the magnetic leakage are reduced especially due to the prevention or reduction of the effects of fastening holes and gaps. Power transformers therefore cause less interference in other circuit components. Because of the reduction in magnetising currents, magnetic leakage and their harmonics, and also because of the higher shear-points and, hence, the improved characteristic operating curves, the EI-core laminations of the invention provide significantly improved transformer cores. A more flattened type construction is provided at the same time which is advantageous for plug-in type assembly.

In addition, the invention further provides a number of constructional advantages which also in part improve the electromagnetic characteristics.

The wider outer legs allow the edges of the parted yoke laminations (I-sections) and also analogously the edges of the windows of the E-sections on the side of the yoke, to be rounded off. These measures which result in disagreeable path constrictions in non-increased width outer legs, but which are practically harmless in increased width outer legs of the invention, are valuable for prolonging the stamping tool life, in particular for case hardened tools. In one sided (not alternately) or unilaterally stacked E- and I- section cores joined together by welding, the E outer leg outer corner opposite the I corner rounding provides a very useful fixing point for the welding arc.

In alternately interleaved stacked cores the jointlessly connected yokes having a larger width $c_1$ overlap, in particular, the parted yokes having a smaller width $c_2$ when the outer edges of the alternating yokes are superimposed with the outer edges lined up. Accordingly, fastening holes are provided in the yokes such that their distance $k_1$ from the outer edge of the jointlessly connected yoke is equal to their distance $k_2$ from the outer edge of the parted yoke ($k_1 = k_2$). In the parted yoke (I-section) it is ordinarily possible and appropriate that the fastening holes are disposed on its center line. From a magnetic point of view this is rather favourable and prevents interference in the production sequence because of symmetry permitting exchange of sides. It is also appropriate to locate the fixing holes at equal distances from the side edges.

By displacement of the abutting joints which are parallel to the yoke, in alternately interleaved stacked cores, by the distance z into the interior of the yoke, the stack thickness increases caused by the burr, which may be left on the laminations after stamping, are displaced from the end of the coil former outwardly into the yoke interior whereby the iron space factor is increased in the coil former and hence the output of the transformer increased. Furthermore, the fixing armature, or transformer clamp pieces, can overlap the area of the abutting joints which reduces mechanical vibration of the ends of the laminations. Such vibration is already reduced because of the small flux load of the joints. The mechanical compressibility of the region of the joints also reduces the burr induced stack height increase of the abutting core laminations and hence the reluctance of the joints is further reduced. Therefore, not only are the magnetising current and the magnetic leakage further reduced, but also the variations of the core characteristics which result during large scale production of transformers.

With the core laminations of the invention, coil formers normally used for conventional waste free core laminations (for example according to the DIN-EI-series) can still be used as well as conventional insulating materials. Normal assembly and production tools such as stacking and winding machines, can also still be used.

Waste free stamping of the EI-core laminations of the invention is also possible in the same way as conventional waste free EI-core laminations by means of the same simple kind of tools. As increased width outer legs have sufficient spare width to allow some minus tolerances, core laminations of final width $a_1$ can be stamped from metal strip of width $a_1$; that is they can be stamped without side trimming ("gridless stamping") which results in savings of material and tooling.

A further object of the invention are low waste or waste free EI-laminations, in which the parted yokes are provided with protrusions which project into the windows. The protrusions yield increased cross section of the yokes and/or improved assembly of the I- and the E-part. Waste free stamping can be obtained, if the protrusions are taken out of the window side of the outer legs. The widths $c_1$ and $c_2$ of the yokes, the width b of the outer legs, the length e and the width h of the windows of such laminations should be understood to be the dimensions of the "basic form", i.e. the corresponding lamination without protrusions. The protrusions may extend along the whole width h of the windows or along part of it. Their window side edge may be straight, oblique or curved. It is favourable to provide protrusions which are so small that the cross-section of the outer legs is nowhere less or considerably less than half the width of the center leg.

Laminations of the invention—with or without the just mentioned protrusions—may be used alternately interleaved or unilaterally assembled. In the last case, the joints may be used as air-gaps, e.g. for chokes. The I- and E-stacks may be welded, clamped, glued or plugged together. Protrusions of the parted yokes may be dimensioned to obtain a pressfit between the ends of the legs, so that the E- and I-stacks can be assembled together by means of any technique of pressing, clamping, glueing or plugging etc. It is appropriate to round off or to bevel the corners of the protrusions to prevent jumping or squeezing, and/or to undercut the protrusions at the end of the inner edges of the outer legs for plug-in type cores in particular.

EI-laminations where the I-pieces are provided with protrusions projecting into the windows are useful for many dimensions of the windows, the legs and the yokes. However, they are particularly useful for the dimensions proposed above.

Three embodiments of the invention will now be described with reference to the drawings.

Figure 1:
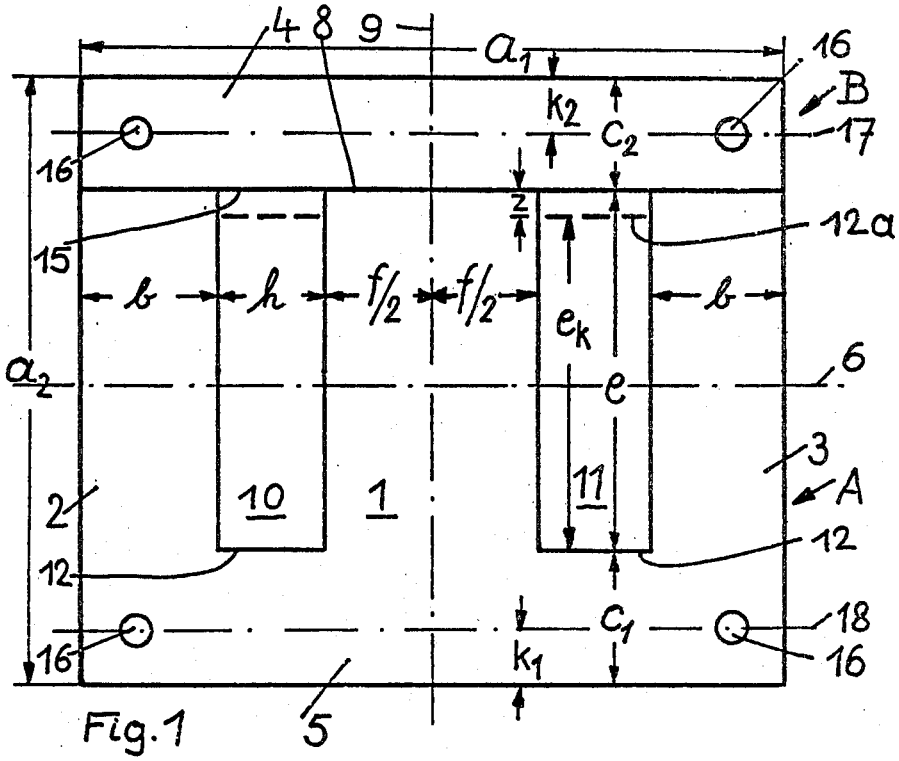
FIG. 1 is a top view of an EI core lamination.

The embodiment of FIG. 1 relates to an EI-core lamination for an iron core for a shell-type core transformer or the like, comprising an E-part A consisting of a yoke 5, a center leg 1 and at a distance two outer legs 2 and 3 parallel thereto, and an I-part B which forms the second yoke 4 of the core lamination. The yoke 4 is separated from both the center leg 1 and the outer legs 2 and 3 by abutting joints 8. The core lamination has a length $a_1$ in the longitudinal direction of the yokes 4 and 5 and a length $a_2$ in the longitudinal direction of the legs, that is in the direction of the longitudinal axis 9, whereby the length $a_1$ is greater than the length $a_2$. The length $a_1$ which corresponds to the whole length of the parted yoke 4 is equal to the width b+b of both the outer legs 2 and 3 plus the width f of the center leg 1 plus the width h+h of both windows 10 and 11. The width h of the windows 10 and 11 corresponds to the width $c_2$ of the parted yoke 4 whereas the length e of the windows 10 and 11 or the legs 1 to 3 respectively correspond to half of the length $a_1$ of the parted yoke 4, so that each pair of E-parts A and each pair of I-parts B can be stamped waste free. In the waste free stamping process the ends of the legs of both E-parts A are turned towards one another and both I-parts B are formed by the stamped out window parts.

The width $c_1$ of the yoke 5 of the E-part A integral with the legs 1 to 3 and the width b of both the outer legs 2 and 3 are about equal to 1.25 times half the width f/2 of the center leg 1.

The windows 10 and 11 are enclosed by the center leg 1, both the outer legs 2 and 3 and both the yokes 4 and 5. As the width $c_1$ of the jointlessly connected yoke 5 is greater than the width $c_2$ of the parted yoke 4, the windows 10 and 11 are asymmetrical relative to the transverse axis 6 of the core lamination.

In shell-type cores having alternately stacked laminations as shown in FIG. 1, the inner edges 12 of the jointlessly connected yoke 5 of the E-parts A form the boundary of the winding space and are usually adjacent to the flange of the coil former. On the other hand, the inner edges 15 of the parted yoke 4, i.e. the I-parts B, are spaced at a distance z from the boundary of the winding space, which distance z is equal to the difference $c_1-c_2$ of the yoke widths. The inside length $e_K$ of the windows of the shell-type core is shorter than the length e of the windows 10 and 11 of the individual core laminations by the difference $c_1-c_2$ of the yoke widths. In the drawing the inner edges 12*a* of the core lamination depicted as oppositely stacked below the top lamination are represented by a dotted line in the region of the windows 10 and 11.

The fastening holes 16 are spaced at the same distances $k_1$ and $k_2$ from both the outer edges which lie parallel to the transverse axis 6 and are located on the center line 17 of the parted yoke 4 or on a corresponding line 18 of the jointlessly connected yoke 5 which is spaced from the outer edge at a distance $k_1$.

Figures 2, 3:
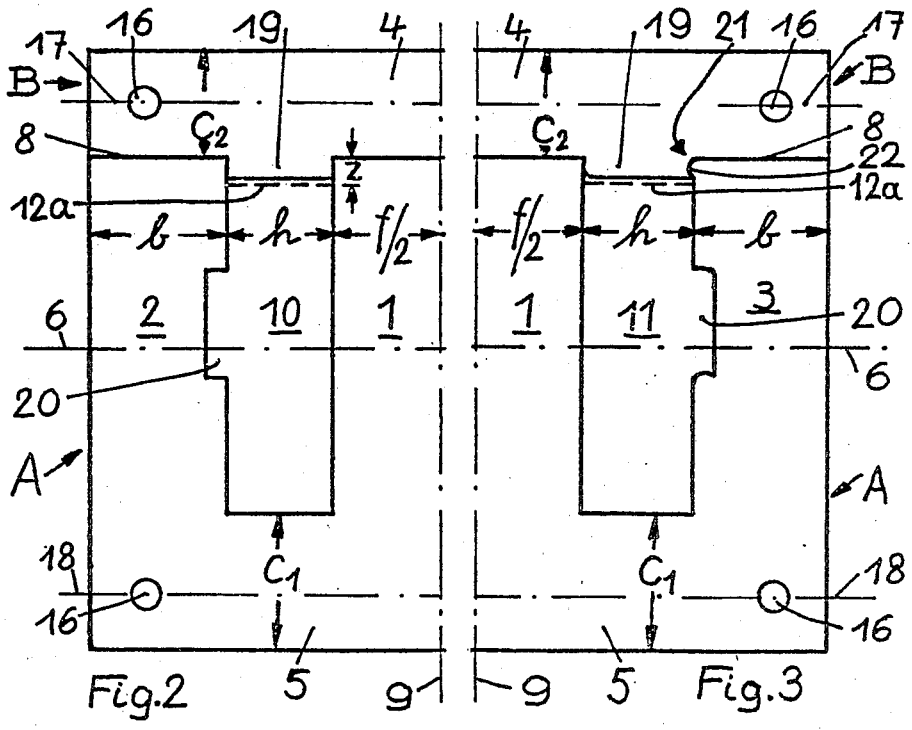
FIG. 2 is a top view of half an EI core lamination having a parted yoke and having protrusions projecting into the windows.
FIG. 3 is a top view of an EI core lamination wherein the protrusions and the ends of the legs are provided with a snap fit.

The magnetic and mechanical characteristics are improved when, as in the embodiment of FIG. 2, the parted yoke 4 is provided with protrusions 19 located in the region of the windows 10 and 11 and having a width h. The average yoke cross-section is already considerably improved at a height of the protrusion 19 of half the difference in the yoke widths $c_1-c_2$. The reduction in cross-section of the outer legs 2 and 3 which being brought about by the recessed cutouts 20 which correspond to the said protrusions and being produced at the side of the windows during waste free stamping, is still quite acceptable. The improvement of magnetic and constructional characteristics by the protrusions is of particular significance when the stacked shell-type cores are produced from core laminations which are assembled as separate E and I stacks.

In this case it is very advantageous if the protrusions 19 and the lateral edges of the associated ends of the outer legs 2 and 3 at the side of the windows comprise a snap fit 21 as shown in the embodiment of FIG. 3. This can be achieved, for instance, by providing a dovetail shaped part on the protrusions 19 at the outer leg side and by providing a corresponding undercut part at the ends of the outer legs on the side of the windows, whereby the convex corners of the protrusions or the ends of the legs may be rounded off or bevelled, so as to make it easier to press them together. It is very advantageous to provide convex shaped increases in width 22 at the ends of the outer legs 2 and 3 and suitable concave recesses at the associated sides of the protrusions 19. By means of these snap connections resilient, form-locking and firmly engaging snap-in type cores can be obtained, in contrast with the cores which are locked by force or glued cores of the embodiment of FIG. 2. Even very small protrusions which do not extend over the entire width h of the window ensure that both stacks can be temporarily and sufficiently reliably held together until they are connected with one another more permanently by means of glueing, welding or clamping.

The embodiments of the invention in which an exclusive property or privilege is claimed are defined as follows:

1. Core laminations for shell-type cores, especially for transformers comprising a plurality of core laminations arranged in layers, each of said core laminations comprising an E-part and an I-part, two said I-parts being formed from the stamped out window parts of two E-parts stamped out with their legs turned toward one another, each of said core laminations having a center leg, two outer legs parallel thereto at a certain distance, and two yokes connecting the ends of said legs, one yoke which will be called the jointlessly connected yoke, being connected without joints to said legs, the other yoke, which will be called the parted yoke, having joints provided between itself and the center leg and between itself and the outer legs, wherein the length (e) of each window (10 or 11) is greater than 3 times and less than 3.5 times half the width (f/2) of the center leg (1) ($3f/2<e<3.5f/2$) and wherein the width ($c_1$) of the jointlessly connected yoke (5) and the width (b) of each of the two outer legs (2 or 3) are each at least 1.1 times and at most 1.5 times half the width (f/2) of the center leg (1) ($1.1f/2\leqq c_1\leqq 1.5f/2$ and $1.1f/2\leqq b\leqq 1.5f/2$) and wherein the difference between the width ($c_1$) of the jointlessly connected yoke (5) and the width ($c_2$) of the parted yoke (4) is at least 0.1 times half the width (f/2) of the center leg (1) ($c_1-c_2\geqq 0.1f/2$) and the width ($c_2$) of the parted yoke is substantially equal to half the width (f/2) of the center leg ($c_2\approx f/2$) and wherein the sum of the width ($c_1$) of the jointlessly connected yoke (5) and the width ($c_2$) of the parted yoke (4) is at least 2.1 times and at most 2.5 times half the width (f/2) of the center leg (1) ($2.1f/2\leqq c_1+c_2\leqq 2.5f/2$) and the length (e) of each window (10 or 11) is equal to half the length ($a_1/2$) of the parted yoke (4) ($e=a_1/2$) and equal to the sum of half the width (f/2) of the center leg (1), the width (h) of each window (10 or 11) and the width (b) of each of the two outer legs (2 or 3) ($e=f/2+h+b$) and the width ($c_2$) of the parted yoke (4) is equal to the width (h) of each window (10 or 11) ($c_2=h$).

2. Core laminations as defined in claim 1 wherein the length (e) of each window (10 or 11) is at least 3.2 times and at most 3.3 times half the width (f/2) of the center leg (1) ($3.2f/2\leqq e\leqq 3.3f/2$).

3. Core laminations as defined in claim 1 wherein the width ($c_1$) of the jointlessly connected yoke (5) and the width (b) of each of the outer legs (2 or 3) are each at least 1.2 times and at most 1.3 times half the width (f/2) of the center leg (1) ($1.2f/2\leqq c_1\leqq 1.3f/2$ and $1.2f/2\leqq b\leqq \frac{1}{3}f/2$).

4. Core laminations as defined in claim 1 wherein the length (e) of each window (10 or 11) is substantially equal to 3.25 times half the width (f/2) of the center leg (1) ($e=3.25f/2$), and wherein the width ($c_1$) of the jointlessly connected yoke (5) and the width (b) of each of the outer legs (2 or 3) are each substantially equal to 1.25 times half the width (f/2) of the center leg (1) ($c_1=1.25f/2$) and wherein the width ($c_2$) of the parted yoke (4) and the width (h) of each window (10 or 11) are each substantially equal to half the width (f/2) of the center leg (1) ($c_2=f/2$).

5. Core laminations preferably as defined in claim 1 wherein the I-parts forming the parted yokes (4) are provided with protrusions (19) projecting into the windows (10 or 11).

6. Core laminations as defined in claim 5, wherein recessed cutouts (20) in the side of the windows of the outer legs (2 or 3) match the protrusions (19) of the parted yoke (4).

7. Core laminations as defined in claim 1, wherein, said core laminations are unilaterally stocked and, the assembled stack (B) comprising parted yokes (4) and the assembled stack (A) comprising E-parts of the core laminations, are fixed together by fixing means.

8. Core laminations as defined in claim 7, wherein the I-pieces forming the parted yokes (4) are provided with protrusions (19) projecting into the windows (10 or 11) and wherein each of the protrusions (19) is provided with rounded off or bevelled corners and wherein each of the protrusions (19) is a pressfit in the window (10 or 11) and/or is provided with an undercut adjacent to the outer leg (2 or 3).

9. Core laminations as defined in claims 5, 6 or 7, wherein snap fits (21) between the I-parts forming the parted yokes (4) and the outer legs (2 or 3) are accomplished by convex ledges (22) of the outer legs (2 or 3) which reach into concave recesses at the associated sides of the protrusions (19) of the I-parts.

10. Core laminations as defined in claims 5 or 6, 7 or 8, wherein the I-parts forming the parted yokes (4) fit without waste in the double windows (10 plus 10 or 11 plus 11) of two assembled E-parts, each of which forming the center leg (1), the outer legs (2 and 3) and the jointlessly connected yoke (5).

11. Core laminations for shell-type cores, especially for transformers comprising a plurality of core laminations arranged in alternatingly reversed layers, each of said core laminations comprising an E-part and an I-part, two said I-parts being formed from the stamped out window parts of two E-parts stamped out with their legs turned toward one another, each of said core laminations having a center leg, two outer legs parallel thereto at a distance, and two yokes connecting the ends of said legs, said yokes being provided with inner edges facing the windows providing the winding spaces, and one yoke which will be called the jointlessly connected yoke, being connected without joints to said legs, the other yoke, which will be called the parted yoke, having abutting joints provided between itself and the center leg and between itself and the outer legs, wherein the length (e) of each window (10 or 11) is greater than 3 times and less than 3.5 times half the width (f/2) of the center leg (1) ($3f/2<e<3.5f/2$) and wherein the width ($c_1$) of the jointlessly connected yoke (5) and the width (b) of each of the outer legs (2 or 3) are each at least 1.1 times half the width (f/2) of the center leg (1) ($c_1 \geqq 1.1f/2$ and $b \geqq 1.1f/2$), and wherein the difference between the width ($c_1$) of the jointlessly connected yoke (5) and the width ($c_2$) of the parted yoke (4) is at least 0.1 times half the width (f/2) of the center leg (1) ($c_1-c_2 \geqq 0.1f/2$) and wherein the sum of the width ($c_1$) of the jointlessly connected yoke (5) and the width ($c_2$) of the parted yoke (4) is at least 2.1 times and at most 2.5 times half the width (f/2) of the center leg (1) ($2.1f/2 \leqq c_1-c_2 \leqq 2.5f/2$) and wherein in said plurality of said core laminations arranged in alternatingly reversed layers, the inner edges of said jointlessly connected yoke forming the boundary of said winding spaces and the inner edges of said parted yoke being spaced at a distance outwardly from the boundary of said winding spaces and said jointlessly connected yoke overlapping said abutting joints and said abutting joints being displaced into the interior of the core yoke which is that portion of the assembled parted yokes and jointlessly connected yokes beyond the winding space.

12. Core laminations as defined in claim 11, wherein the length (e) of each window (10 or 11) is equal to half the length ($a_1/2$) of the parted yoke (4)($e=a_1/2$) and equal to the sum of half the width (f/2) of the center leg (1), the width (h) of each window (10 or 11) and the width (b) of each of the two outer legs (2 or 3)($e=f/2+h+b$).

13. Core laminations as defined in claim 11, wherein the width ($c_2$) of the parted yoke (4) is equal to the width (h) of each window (10 or 11) ($c_2=h$).

14. Core laminations as defined in claim 11 wherein the length (e) of each window (10 or 11) is substantially equal to 3.25 times half the width (f/2) of the center leg (1)($e=3.25f/2$), wherein the width ($c_1$) of the jointlessly connected yoke (5) and the width (b) of each of the outer legs (2 or 3) are each substantially equal to 1.25 times half the width (f/2) of the center leg (1)($c_1=b=1.25f/2$) and wherein the width ($c_2$) of the parted yoke (4) and the width (h) of each window (10 or 11) are each substantially equal to half the width (f/2) of the center leg (1)($c_2=h=f/2$).

15. Core laminations as defined in ((one or more of)) claims 1, 11, 12 or 13, wherein the width ($c_1$) or the jointlessly connected yoke (5) is substantially equal to the width (b) of the two outer legs (2 or 3) ($c_1=b$).

16. Core laminations as defined in claims 1, 11, 12 or 13, wherein I-parts forming the parted yoke (4) are provided with rounded off or bevelled corners.

17. Core laminations as defined in claims 1, 11, 12 or 13 wherein the yokes (4 or 5) are provided with fastening holes (16) and wherein the distance ($k_1$) of the fastening holes (16) to the outer edge of the jointlessly connected yoke (5) is equal to the distance ($k_2$) of the fastening holes (16) to the outer edge of the parted yoke (4)($k_1=k_2$).

18. Core laminations as defined in claims 1, 11, 12 or 13, wherein the fastening holes (16) in the parted yoke (4) are provided at the center line (17) thereof.

19. Core laminations as defined in claims 5, 11, 12 or 13, wherein, said core laminations are alternately interleaved and, the joints (8) parallel to each yoke (4 or 5) are covered up by the jointlessly connected yoke (5) of an adjacent core lamination and are spaced from the legs (1 to 3) of the adjacent core lamination at a distance (z) equal to the difference between the width ($c_1$) of the jointlessly connected yoke (5) and the width ($c_2$) of the parted yoke (4) ($z=c_1-c_2$).

20. Core laminations of claims 11 or 12 or 13 wherein the length (e) of each window (10 or 11) is at least 3.2 times and at most 3.3 times half the width (f/2) of the center leg (1)($3.2f/2 \leqq e \leqq 3.3f/2$).

21. Core laminations of claims 11 or 12 or 13, wherein the width ($c_1$) of the jointlessly connected yoke (5) and the width (b) of each of the outer legs (2 or 3) are each at least 1.2 times and at most 1.3 times half the width (f/2) of the center leg (1)($1.2f/2 \leqq c_1 \leqq 1.3f/2$ and $1.2f/2 \leqq b \leqq 1.3f/2$).

* * * * *